United States Patent [19]

Post

[11] 4,172,567

[45] Oct. 30, 1979

[54] KITE REEL DEVICE

[76] Inventor: Ferdinand J. Post, 1874 W. Skillman, Roseville, Minn. 55113

[21] Appl. No.: 906,102

[22] Filed: May 15, 1978

[51] Int. Cl.[2] ..... B65H 75/40

[52] U.S. Cl. ..... 242/96; 244/155 A

[58] Field of Search ..... 242/96, 99, 100, 84.8; 244/153-155

[56] References Cited

U.S. PATENT DOCUMENTS

| | | | |
|---|---|---|---|
| 3,338,536 | 8/1967 | Hull | 244/155 A |
| 3,409,255 | 11/1968 | Sada | 242/96 X |
| 3,652,027 | 3/1972 | Wong | 242/96 |
| 4,065,080 | 12/1977 | Alison | 242/96 |

*Primary Examiner*—Edward J. McCarthy

*Attorney, Agent, or Firm*—Williamson, Bains, Moore & Hansen

[57] ABSTRACT

A kite reel device includes an elongate shaft having a reel slidably mounted thereon. An elongate sleeve formed of somewhat flexible, plastic material is loosely positioned around the shaft for relative sliding and rotative movement therebetween. The shaft can also be gripped to prevent rotation of the reel. When the sleeve is tightly gripped and compressed against the shaft, the sleeve serves as a brake for the shaft and the reel thereon. When the reel is shifted to one end of the shaft and the sleeve is loosely gripped, the reel and shaft may be revolved as a unit thereby permitting winding of the reel. In another embodiment of the invention, two reels are slidably mounted on a shaft and permit controlled maneuvering of the kite.

8 Claims, 3 Drawing Figures

KITE REEL DEVICE

SUMMARY OF THE INVENTION

This invention relates to kite reels.

An object of this invention is to provide a kite reel device, of simple and inexpensive construction, including a reel slidably mounted on an elongate shaft, and a control sleeve on the shaft for controlling winding and unwinding of the reel.

Another object of this invention is to provide a novel kite reel device including a pair of reels slidably mounted on a shaft each having cord wound thereon and attached to a kite for controlling the flying of the latter.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 1:
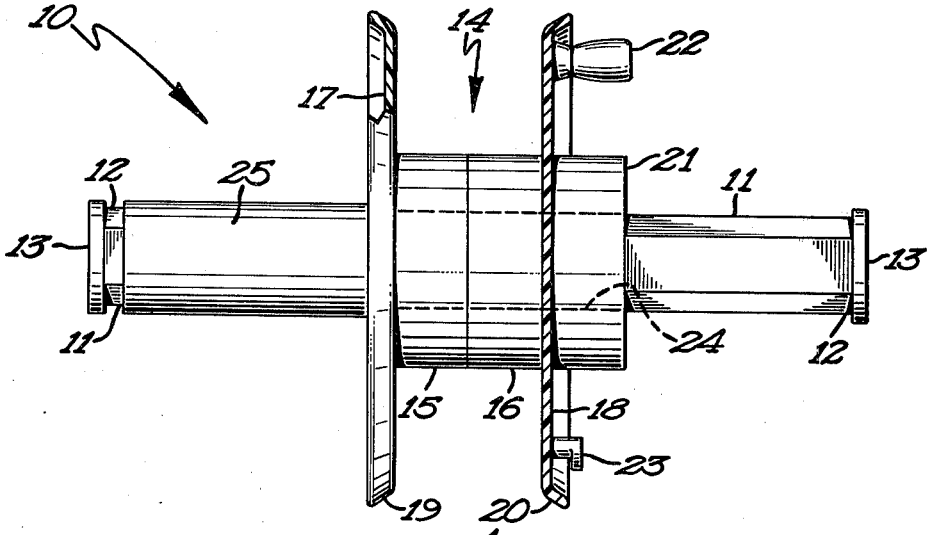
FIG. 1 is an elevational view of one embodiment of the novel kite reel device illustrating the device in condition for flight or unwinding of the reel thereon.
Figure 2:
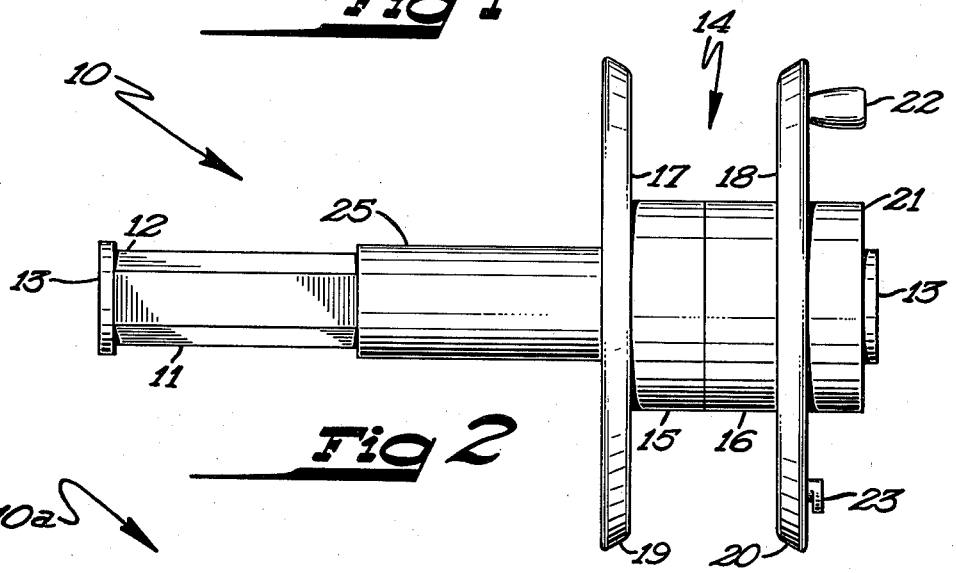
FIG. 2 is an elevational view similar to FIG. 1 but illustrating the reel device adjusted for winding.

Referring now to the drawings and more particularly to FIGS. 1 and 2, it will be seen that one embodiment of the reel device, designated generally by the reference numeral 10, is thereshown. The reel device 10 includes an elongate substantially straight, preferably hollow shaft 11 which is of hexagonal cross-sectional configuration. End members 12 are inserted into the ends of the shaft 11 and each end member 12 is provided with a flange 13 which extends radially outwardly therefrom.

A spool or reel 14 is slidably mounted on the hexagonal shaft and includes a pair of cylindrical hub elements 15 and 16 which are sealingly secured together in end to end relation. The other end of the hub element 16 is provided with a radial flange or plate 18 which extends outwardly therefrom. Similarly, the hub element 15 is provided with an outwardly extending radial flange 17 at its other end. The radial flanges are of similar size, and the radial flange 17 is provided with an outturned circumferential annular lip 19 at its periphery while the flange 18 is provided with an outturned annular lip 20 at its periphery.

The radial flange 18 is provided with a cylindrical boss 21 which is integral therewith and projects axially therefrom. It is pointed out that the reel 14 may be made of a suitable plastic material and formed in a molding operation, if desired. The radial flange 18 is also provided with a small knob or handle 22 which is integral therewith and which projects outwardly from the outer side thereof and which serves to facilitate revolving or winding movement of the reel 14. A string engaging element 23 is also integrally formed with the flange 18 and projects axially from the outer surface or face thereof. It will be noted that the string engaging element 23 is located approximately 180 degrees from the handle 22. It will further be noted that the opening or bore 24 through the hub elements is of hexagonal configuration slightly larger than the cross-sectional dimension of the hexagonal shaft 11. This facilitates sliding movement of the reel relative to the shaft 11.

An elongate cylindrical control sleeve 25 is loosely mounted on the shaft 11 and is disposed between one of the end members 12 and the flange 17 of the reel 14. The control sleeve 25 is preferably formed of a plastic material and although it is dimensionally stable, the sleeve may be tightly gripped and compressed against the shaft 11 by the user. The sleeve 25 facilitates winding and unwinding of the reel 14.

In use, the kite string or cord will be wound upon the hub of the reel 14 and will have one end thereof attached to a kite. The reel 14 will be positioned as shown in FIG. 1 so that it is disposed substantially midway of the shaft 11 and the control sleeve will be positioned adjacent one end of the shaft. The control sleeve 25 will be loosely grasped by the user thereby permitting the reel 14 and shaft 11 to free wheel or freely rotate relative to the sleeve. The sleeve 25 may be compressed against the shaft 11 to brake revolving movement of the shaft and reel relative to the sleeve, but the reel rotation is stopped by grabbing the hexagonal shaft 1. The kite string will be unwound from the reel while in the position illustrated in FIG. 1 and will be maintained in this position during the flight of the kite. If it is desirable to maintain the kite at a predetermined altitude or with a predetermined length of string, the user will wind or loop the kite string against further unwinding. The relatively long shaft permits the user to grip both end portions of the shaft to facilitate maneuvering of the kite. In this respect, it will be noted that the shaft 11 is substantially longer than the combined length of the control sleeve 25 and the reel 14.

When it is desirable to wind the kite string about the hub of the reel 14, the control sleeve and reel 14 will be urged towards the opposite end of the shaft from that shown in FIG. 1 to the position illustrated in FIG. 2. When so disposed, the boss 21 of the reel 14 will be positioned adjacent the flange 13 of the adjacent end member 12. The sleeve 25 will be loosely gripped and when the knob 22 is grasped to revolve the reel 14, the reel and elongate shaft 11 will rotate as a unit relative to the control sleeve. The reel 14 and shaft 11 will be rotated until the string is wound upon the reel 14. It is again pointed out that the control sleeve may be clamped against the shaft 11 to brake revolving movement thereof. It is also pointed out that the boss 21 serves to space a user's hand from the adjacent flange 21 a sufficient distance to prevent the knob 22 from striking the user's hand during rotation of the reel. This is especially desirable when the reel unwinds rapidly as the string is let out.

Figure 3:
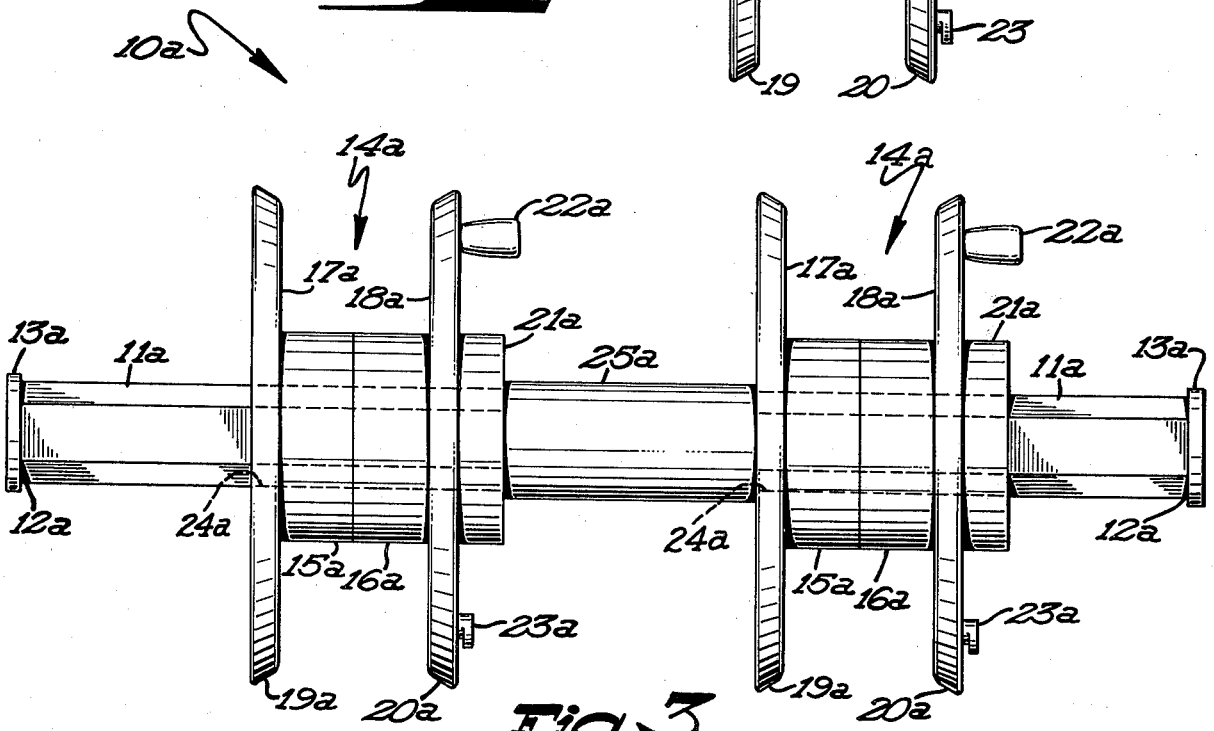
FIG. 3 is an elevational view of a different embodiment of the reel device.

Referring now to FIG. 3, it will be seen that a different embodiment of the kite reel device, designated generally by the reference numeral 10*a* is thereshown. The reel device 10*a* also includes an elongate substantially straight hollow shaft ll*a* of hexagonal cross-sectional configuration. The shaft 11*a* is also provided with end members 12*a* which are telescoped into the shaft 11*a* and each end member is provided with a radial flange 13*a*.

The reel device 10*a* is provided with a pair of spools or reels 14*a* of substantially similar construction, each including a hub comprised of a cylindrical hub element 15*a* and a cylindrical hub element 16*a* sealingly secured in end to end relation by a suitable cementing material such as glue, plasticizers and the like. It is pointed out that two reels can also be used with the embodiment of FIGS. 1 and 2. In this respect, it is pointed out that the reel 14*a* may be formed of a suitable plastic material in a molding process. The hub element 15*a* is provided with a radial flange or plate 17*a* which extends radially outwardly from one end thereof, and the hub element 16*a* is provided with a radial flange or plate 18*a* which extends radially outwardly from one end thereof. It will be noted that the flange 17*a* has an outturned annular lip 19*a*, and that the flange 18*a* is provided with an outturned annular lip 20*a* at its periphery.

It will be noted that both of the reels 14*a* are provided with a boss 21*a*, each boss being secured to the outer flange 18*a* of the associated reel. Both reels are also provided with a knob or handle 22*a* which is affixed to the flange 18*a* of the associated reel and projects axially therefrom. Similarly, both reels are provided with a string engaging element 23*a*, the latter being affixed to the flange 18*a* of the associated reel and projecting axially therefrom at a position located 180 degrees with respect to the associated knob 22*a*.

It will be noted that the bore or opening 24*a* in the hub elements 15*a* and 16*a* is also of hexagonal cross-sectional configuration and is slightly greater than the cross-sectional size of the hexagonal shaft 11*a*. Thus, each of the reels 14*a* may slide relative to the shaft 11*a*. A control sleeve 25*a* is loosely positioned around on the shaft 11*a* and the control sleeve is substantially identical to that disclosed in the embodiment of FIGS. 1 and 2. The control sleeve 25*a* is formed of a suitable plastic material and is dimensionally stable but is capable of being gripped and compressed against the shaft 11*a*. In this respect, the control sleeve 25*a* will be loosely held to permit the reels 14*a* and shaft 11*a* to free wheel or freely rotate relative to the sleeve 25*a*. It will be noted that the sleeve 25*a* is positioned between the reels 14*a*, and that the combined lengths of the two reels and control sleeve is substantially less than the overall length of the shaft 11*a*.

In use, a cord or tight string will be wound about the reels 14*a* and one end of each string will be connected to a kite at different locations thereon. By manipulating the particular kite strings, the kite may be controlled and maneuvered during its flight. During winding or unwinding of the kite reels, the control sleeve will be held loosely to permit the shaft 11*a* and reels 14*a* to rotate. The reels will then rotate in unison with the shaft 11*a* thus permitting both reels to be wound simultaneously. The sleeve 25*a* may be used to brake revolving movement of the reels and shaft as desired. The primary braking function as performed by grabbing the shaft 11*a*.

From the foregoing description, it will be seen that I have provided a novel kite reel device, which is of simple and inexpensive construction, and which functions in a more efficient manner than any heretofore comparable kite reel.

What is claimed is:

1. A kite reel device comprising:

an elongate shaft, a reel, including a cylindrical hub mounted on said shaft for longitudinal movement relative thereto, said hub having a pair of axially spaced apart flanges affixed thereto and extending radially outwardly therefrom, a handle on one of said flanges projecting axially therefrom, a string engaging element on said one flange projecting therefrom and being spaced from said handle, an elongate sleeve positioned around said shaft and being slidable therealong, said sleeve being yieldable in response to pressure applied thereto to permit a user to compress the sleeve against the shaft and thereby prevent rotative movement of the shaft and the reel relative to the sleeve, said sleeve when loosely held by the user permitting the reel and shaft to freely rotate as a unit.

2. A reel device as defined in claim 1 wherein said shaft is of hexagonal, cross-sectional configuration.

3. The reel device as defined in claim 1 wherein said sleeve is formed of plastic material.

4. The reel device as defined in claim 1 and a second reel including a hub mounted on said shaft for longitudinal movement relative thereto, said second reel having a pair of flanges affixed to the hub thereof and projecting radially therefrom.

5. The reel device as defined in claim 4 wherein said sleeve is positioned between said reels.

6. The reel device as defined in claim 5 wherein said shaft is of hexagonal configuration.

7. The reel device as defined in claim 6 wherein said shaft has a length dimension substantially greater than the combined axial dimensions of said reels and sleeve.

8. A kite reel device comprising:

an elongate shaft, a reel, including a cylindrical hub mounted on said shaft for longitudinal movement relative thereto, said hub having a pair of axially spaced apart flanges affixed thereto and extending radially outwardly therefrom, a handle on one of said flanges projecting axially therefrom, an elongate sleeve positioned around said shaft and being slidable therealong, said sleeve being yieldable in response to pressure applied thereto to permit a user to compress the sleeve against the shaft and thereby prevent rotative movement of the shaft and the reel relative to the sleeve, said sleeve when loosely held by the user permitting the reel and shaft to freely rotate as a unit.

* * * * *